US009132679B1

(12) United States Patent
Mutsuno

(10) Patent No.: US 9,132,679 B1
(45) Date of Patent: Sep. 15, 2015

(54) IMAGE FORMING APPARATUS, METHOD OF CONTROLLING THE SAME, AND COMPUTER-READABLE STORAGE MEDIUM

(71) Applicant: CANON KABUSHIKI KAISHA, Tokyo (JP)

(72) Inventor: Masahiro Mutsuno, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/672,828

(22) Filed: Mar. 30, 2015

(30) Foreign Application Priority Data

Apr. 15, 2014 (JP) ..... 2014-084000

(51) Int. Cl.
*B41J 29/393* (2006.01)
*B41J 29/38* (2006.01)
*B41J 13/00* (2006.01)

(52) U.S. Cl.
CPC ..... *B41J 29/38* (2013.01); *B41J 13/0009* (2013.01)

(58) Field of Classification Search
CPC ..... B41J 11/46; B41J 11/0095; B41J 11/007; B41J 13/0009; B41J 2/04541; B41J 11/42; B41J 2/04505
See application file for complete search history.

(56) References Cited

U.S. PATENT DOCUMENTS

| | | | | |
|---|---|---|---|---|
| 7,950,766 | B2 * | 5/2011 | Ejiri et al. | 347/19 |
| 8,490,970 | B2 | 7/2013 | Mutsuno | |
| 8,840,217 | B2 * | 9/2014 | Yamagata | 347/16 |
| 8,909,087 | B2 | 12/2014 | Unno | |
| 8,926,054 | B2 * | 1/2015 | Emoto et al. | 347/19 |

FOREIGN PATENT DOCUMENTS

JP 2008-30451 A 2/2008

* cited by examiner

*Primary Examiner* — Lamson Nguyen
(74) *Attorney, Agent, or Firm* — Fitzpatrick, Cella, Harper & Scinto

(57) ABSTRACT

An image forming apparatus including a plurality of paper feeding units and a method of controlling the same are provided, wherein out-of-paper in at least one of the plurality of paper feeding units is detected, and a failure in at least one of the plurality of paper feeding units is detected. The apparatus controls to permit selecting a paper feeding unit to be used as a paper feeding source of paper in which the out-of-paper is detected, and the apparatus controls not to permit selecting the paper feeding unit in which the failure is detected.

7 Claims, 9 Drawing Sheets

IMAGE FORMING APPARATUS, METHOD OF CONTROLLING THE SAME, AND COMPUTER-READABLE STORAGE MEDIUM

BACKGROUND OF THE INVENTION

1. Field of the Invention

The present invention relates to an image forming apparatus, a method of controlling the same, and a computer-readable storage medium.

2. Description of the Related Art

A conventional image forming apparatus includes at least one or more paper feeding apparatuses that store paper, such as paper feeding cassettes and paper feeding decks. For example, Japanese Patent Laid-Open No. 2008-030451 discloses an image forming apparatus including two cassettes and one deck as paper feeding apparatuses. In the image forming apparatus including the plurality of paper feeding apparatuses, the paper feeding apparatus to be used for printing can be allocated for jobs, such as copying, a print job from a printer driver, and reception of FAX.

In the image forming apparatus, there is a case in which part of the paper feeding apparatuses breaks down due to a failure of a roller or the like. In the conventional image forming apparatus, the entire apparatus enters an error state when the failure is detected, and the use of the apparatus becomes impossible. In this case, although the other paper feeding apparatuses are not broken down, the apparatus cannot be used until the paper feeding apparatus with the failure is repaired, and there is a problem that the work efficiency is reduced.

SUMMARY OF THE INVENTION

An aspect of the present invention is to eliminate the above-mentioned problems with the conventional techniques.

A feature of the present invention is to provide a technique of executing an image forming process by using another paper feeding apparatus which does not break down when a failure of any one of a plurality of paper feeding apparatuses is detected.

According to a first aspect of the present invention, there is provided an image forming apparatus having a plurality of paper feeding units, the image forming apparatus comprising: a first detection unit configured to detect out-of-paper in at least one of the plurality of paper feeding units; a second detection unit configured to detect a failure in at least one of the plurality of paper feeding units; a selection unit configured to select one of the plurality of paper feeding units that is to be used as a paper feeding source of paper; and a control unit configured to control the selection unit to permit selecting the paper feeding unit in which the out-of-paper is detected by the first detection unit and to control the selection unit not to permit selecting the paper feeding unit in which the failure is detected by the second detection unit.

According to a second aspect of the present invention, there is provided a method of controlling an image forming apparatus comprising a plurality of paper feeding units, the method comprising: a first detection step of detecting out-of-paper in at least one of the plurality of paper feeding units; a second detection step of detecting a failure in at least one of the plurality of paper feeding units; a selection step of selecting one of the plurality of paper feeding units that is to be used as a paper feeding source of paper; and a control step of controlling the selection step to permit selecting the paper feeding unit in which the out-of-paper is detected in the first detection step and of controlling the selection step not to permit selecting the paper feeding unit in which the failure is detected in the second detection step.

Further features of the present invention will become apparent from the following description of exemplary embodiments with reference to the attached drawings. In the attached drawings, the same or similar components are designated with the same reference numerals.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will now be described hereinafter in detail, with reference to the accompanying drawings. It is to be understood that the following embodiments is not intended to limit the claims of the present invention, and that not all of the combinations of the aspects that are described according to the following embodiments are necessarily required with respect to the means to solve the problems according to the present invention.

Figure 1:
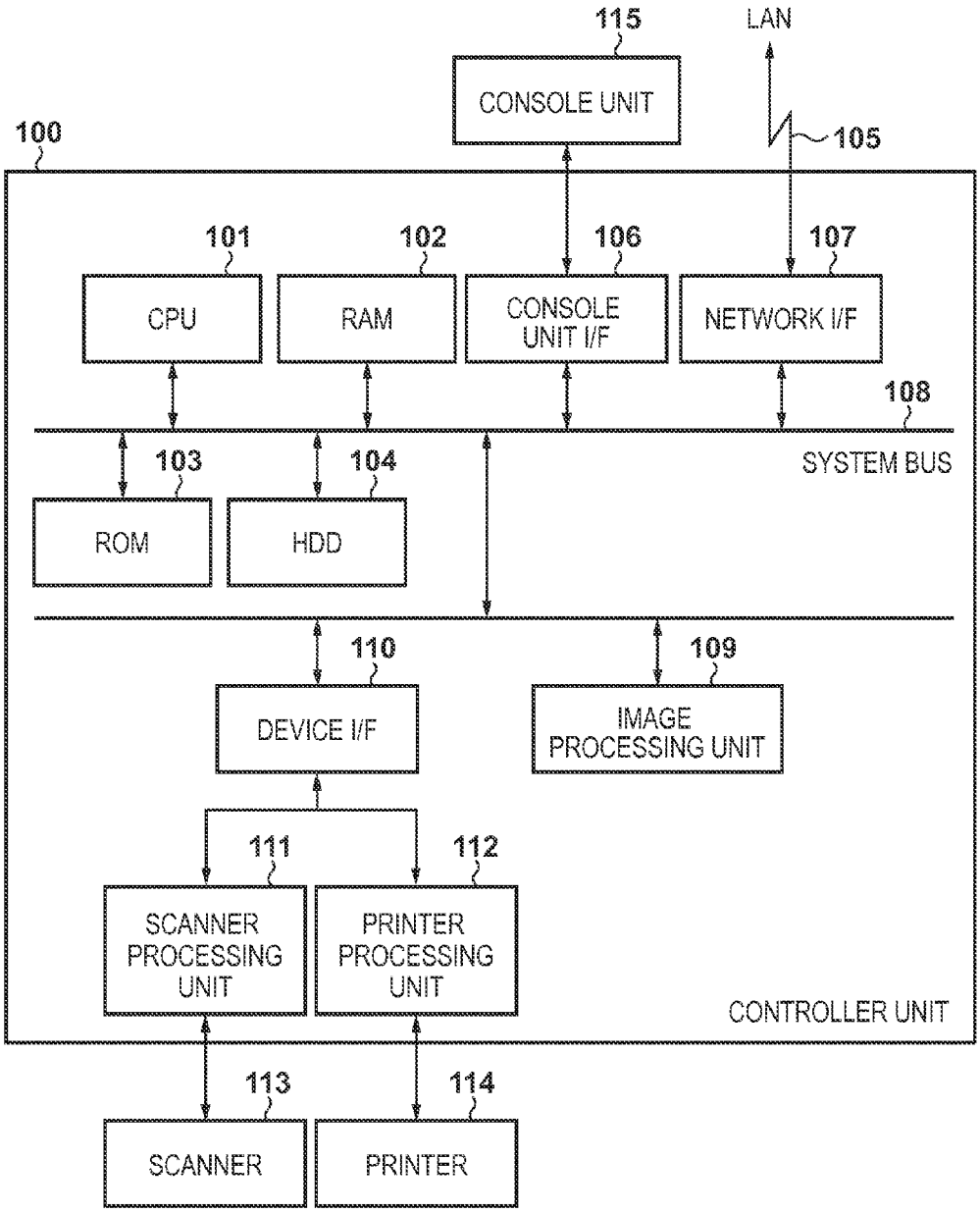
FIG. 1 is a block diagram describing an overall configuration of an image forming apparatus according to embodiments of the present invention.

FIG. 1 is a block diagram showing an overall configuration of an image forming apparatus according to embodiments of the present invention.

The image forming apparatus includes: a controller unit (control unit) 100 that controls the entire apparatus; a scanner 113 that is a device for inputting image data; a printer 114; and a console unit 115 for displaying input of an instruction from an operator and information for the operator. The scanner 113 is connected to a scanner processing unit 111, and the printer 114 is connected to a printer processing unit 112. The scanner processing unit 111, the printer processing unit 112, and the console unit 115 are connected to the control unit 100 through a device I/F 110 or a console unit I/F 106 and are controlled by instructions from the control unit 100.

A CPU 101 of the control unit 100 is connected to a RAM 102, a ROM 103, an HDD 104, the console unit I/F 106, and a network I/F 107 through a system bus 108. The RAM 102 is a memory that provides a work area of the CPU 101, and the RAM 102 includes a setting value storage area for temporarily storing settings such as parameters and an image memory area for temporarily storing image data. The ROM 103 is a boot ROM storing a system boot program. An OS, a control program, parameter setting values, image data, and the like are stored in the HDD 104. The CPU 101 executes the boot program stored in the ROM 103 to execute the OS and the program installed in the HDD 104 by deploying the OS and the program into the RAM 102 to thereby control the operation of the entire apparatus. The console unit I/F 106 is an interface for input and output between the control unit 100 and the console unit 115. The console unit I/F 106 outputs, to the console unit 115, image data to be displayed in response to an instruction from the CPU 101 and transmits, to the CPU 101, information input by the operator through the console unit 115. The network I/F 107 is connected to a LAN 105 to input and output information to and from the LAN 105.

An image processing unit 109 develops a PDL code received from the LAN 105 into a bitmap image. The image processing unit 109 converts image data compressed, coded, and stored in the HDD 104 into image data in a format that can be used in the printer processing unit 112 and transfers the image data to the printer processing unit 112. The printer processing unit 112 receives the processed image data to convert the image data into data that can be printed by the printer 114 and outputs the data to the printer 114. The scanner 113 and the printer 114 are respectively connected to the device I/F 110 through the scanner processing unit 111 and the printer processing unit 112, and the device I/F 110 converts synchronous/asynchronous of image data and transmits data of setting values, adjustment values, and device state. The scanner processing unit 111 applies various processes of editing and the like to the image data input from the scanner 113, such as correction, processing, region segmentation, scaling, and binarization processing.

The scanner 113 includes an auto document feeder and a reading unit through platen not shown and can read both sides of a plurality of pieces of documents. The scanner 113 also includes sensors that detect open or close of an original cover plate not shown, presence or absence of an original, and the size of the original, and the information detected by the sensors and state information of the scanner 113 are transmitted to the CPU 101 through the scanner processing unit 111 and the device I/F 110. The printer processing unit 112 applies processing, such as correction and resolution conversion according to the characteristics of the printer 114, and processing, such as adjustment of the print position of the image, to the image data to be printed and output. As described later with reference to FIG. 3, the printer 114 includes a plurality of paper feeding apparatuses that store paper used for printing.

Figure 2:
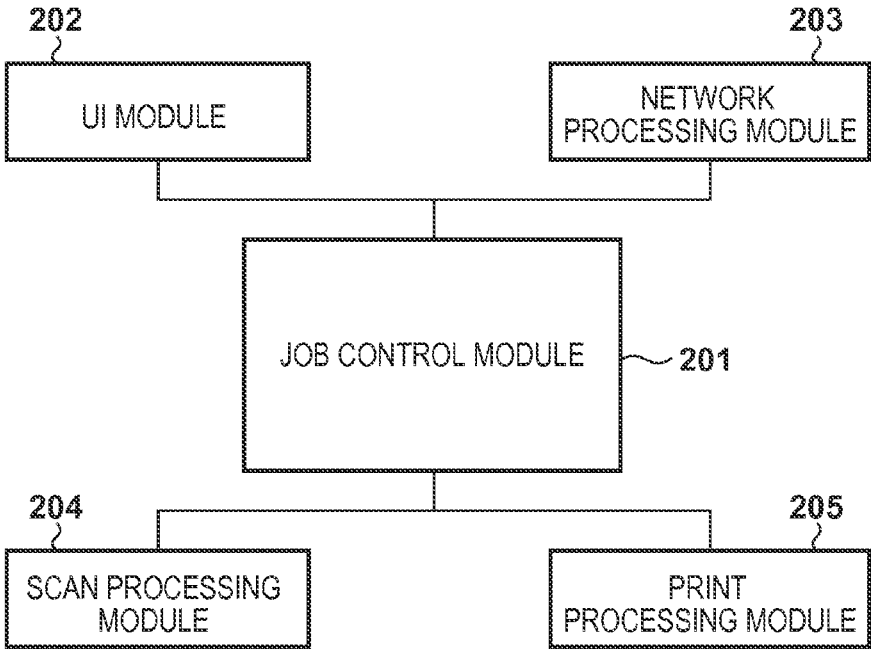
FIG. 2 is a block diagram describing software modules of the image forming apparatus according to the embodiments.

FIG. 2 is a block diagram describing software modules of the image forming apparatus according to the embodiments. The CPU 101 mainly executes the control program to realize each software module illustrated here.

A job control module 201 submits and controls each software module and controls all jobs, such as copying, printing, scanning, and UI processing, generated in the image forming apparatus. A UI (User Interface) module 202 mainly performs control related to the console unit 115 and the console unit I/F 106. The UI module 202 notifies the job control module 201 of the operation on the console unit 115 by the operator and controls the display of a display screen of the console unit 115 based on an instruction from the job control module 201. The UI module 202 also performs control, such as editing of drawing data to be displayed on the console unit 115. A network processing module 203 is a module that mainly controls communication with external devices performed through the network I/F 107 and is configured to control communication with the external devices on the LAN 105. When a control command or data is received from the devices on the LAN 105, the network processing module 203 notifies the job control module 201 of the content. The network processing module 203 transmits a control command or data to the external devices on the LAN 105 based on an instruction from the job control module 201.

A scan processing module 204 controls the scanner 113 and the scanner processing unit 111 based on an instruction of the job control module 201 and instructs the scanner 113 to read a document. The scan processing module 204 instructs the scanner processing unit 111 to apply image processing to the image data of the document received from the scanner 113 and obtains state information of the scanner processing unit 111 and the scanner 113 to notify the job control module 201 of the state information. A print processing module 205 controls the image processing unit 109, the printer processing unit 112, and the printer 114 based on an instruction of the job control module 201 to execute designated image processing to perform printing. The print processing module 205 receives information, such as image data, image information (size of image data, color mode, resolution, and the like), layout information (offset, scaling, imposition, and the like), and output paper information (size and print direction), from the job control module 201. The print processing module 205 controls the image processing unit 109 and the printer processing unit 112 to apply instructed image processing to the image data and controls the printer 114 to perform printing. The print processing module 205 obtains state information of the printer processing unit 112 and the printer 114 and notifies the job control module 201 of the state information.

Figure 3:
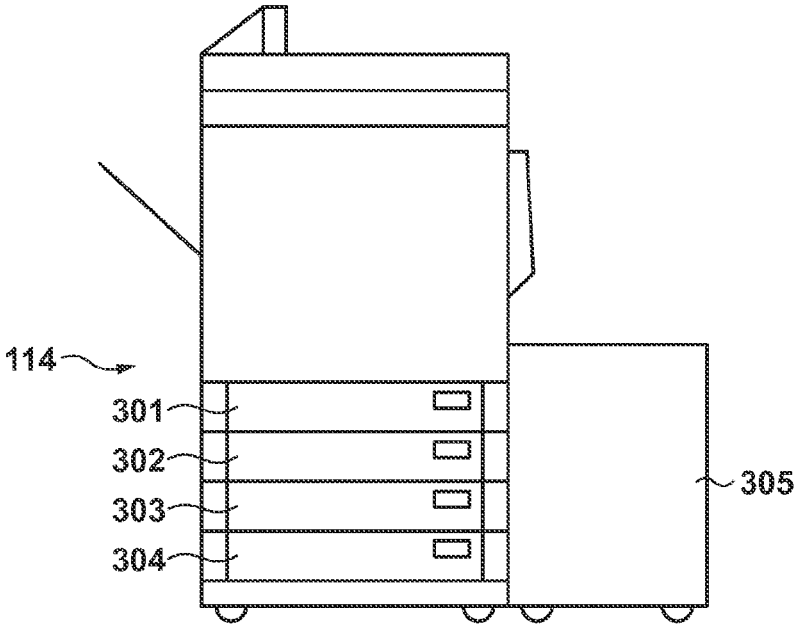
FIG. 3 depicts an overview illustrating the image forming apparatus according to the embodiments.

FIG. 3 depicts an overview of the image forming apparatus according to the embodiments.

The printer 114 of the image forming apparatus includes a plurality of paper feeding apparatuses. The paper feeding apparatuses include paper feeding cassettes 301 to 304 and a deck 305. The deck 305 can house a large amount of paper (sheets) and has a curl correction function, an air heater function, and a paper separating fan function. In the air heater function, a heater is turned on and off based on information of paper and the humidity. In the paper separating fan function, an air volume of an adsorption fan is adjusted. In the curl correction function, a normal curl (convex downward) and a reverse curl (convex upward) of paper can be corrected. The paper feeding apparatuses detect information related to the paper feeding apparatuses including the size and the remaining amount of the housed paper as well as a state, such as open or close of the door, and notify the CPU 101 of the information through the printer processing unit 112 and the device I/F 110.

First Embodiment

Operation when there is a failure in a paper feeding apparatus possessed by the printer 114 of the image forming apparatus according to a first embodiment will be described.

Figure 4:
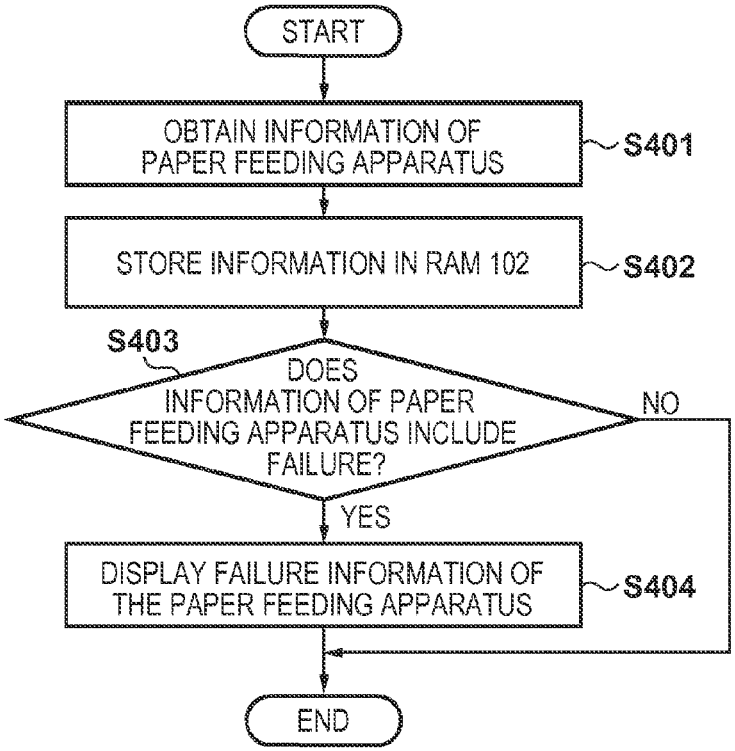
FIG. 4 is a flowchart for describing a process when a failure is detected in a paper feeding apparatus in the image forming apparatus according to a first embodiment of the present invention.

FIG. 4 is a flowchart for describing a process when a paper feeding apparatus detects a failure in the image forming apparatus according to the first embodiment of the present invention. The CPU 101 executes a program deployed from the HDD 104 into the RAM 102 to attain the process illustrated in the flow chart.

In step S401, the CPU 101 obtains information of the paper feeding apparatus through the printer processing unit 112 and the device I/F 110. The CPU 101 proceeds to step S402 and stores the obtained information in the RAM 102. The CPU 101 proceeds to step S403 and determines whether the obtained information includes information of a failure of the paper feeding apparatus. The failure of the paper feeding apparatus includes a case in which the paper does not reach a conveyable position when the paper is to be lifted up to the conveyable position in the paper feeding apparatus to convey the paper from the paper feeding apparatus to the printer engine of the printer 114. In a case that the paper feeding apparatus has an advanced function, such as the deck 305 of FIG. 3, an abnormality in various sensors with the curl correction function, the air heater function, the paper separating fan function, and the like becomes also a failure, and this is an error in which the paper feeding operation cannot be continued.

If the CPU 101 determines that the obtained information includes information indicating a failure that does not allow execution of the paper feeding operation in step S403, the CPU 101 proceeds to step S404 to display the information of the paper feeding apparatus on the console unit 115 and ends the process. If the CPU 101 determines that the obtained information does not include information indicating a failure in step S403, the CPU 101 ends the process.

Figure 5:
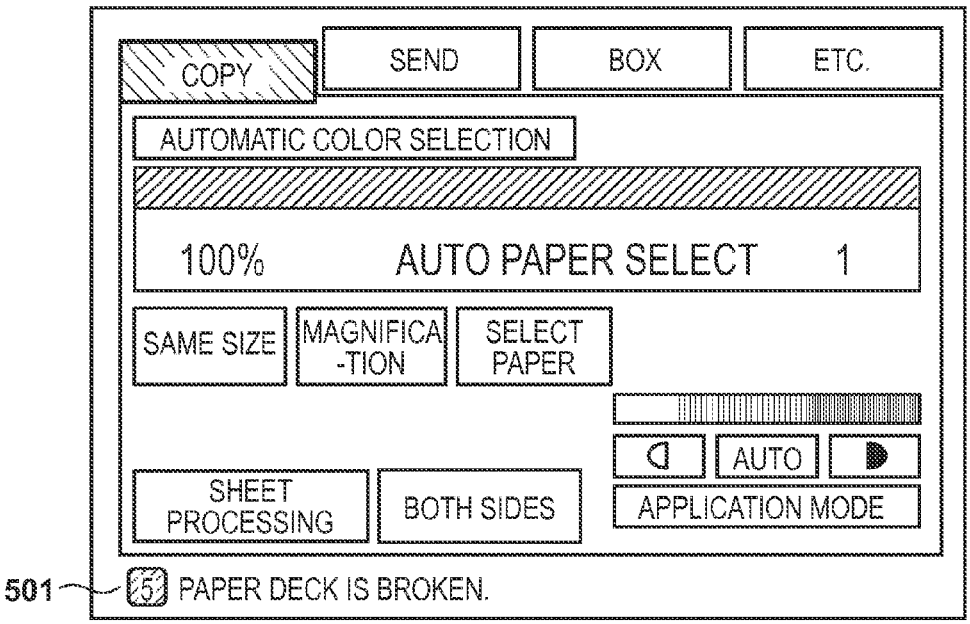
FIG. 5 depicts a view illustrating an example of a screen displayed on a console unit when a failure is detected in a paper deck in the image forming apparatus according to the first embodiment.

FIG. 5 depicts a view showing an example of a screen displayed on the console unit 115 when the image forming apparatus according to the first embodiment detects a failure in the paper deck. FIG. 5 illustrates an example of a screen when there is a failure in the paper deck 305, and a message 501 informs that there is a failure in the paper deck 305.

Figure 6:
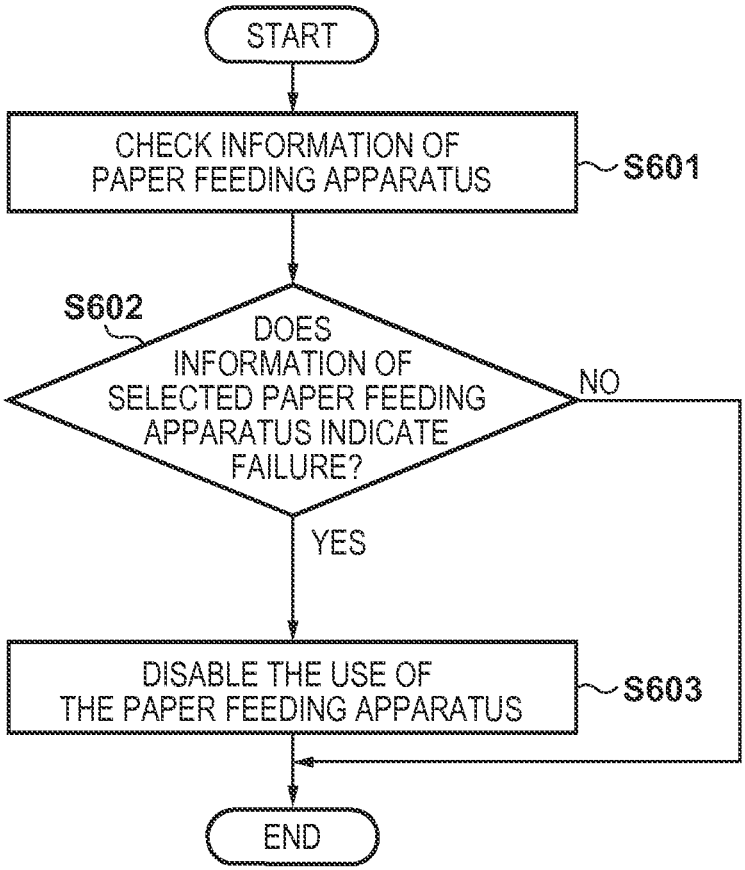
FIG. 6 is a flowchart for describing a process when a failure is detected in the paper feeding apparatus in the image forming apparatus according to the first embodiment.

FIG. 6 is a flowchart for describing a process when a failure is detected in the paper feeding apparatus in the image forming apparatus according to the first embodiment.

When the CPU 101 checks the information of the paper feeding apparatus selected by the console unit 115 in 5601, the CPU 101 proceeds to S602. In step S602, the CPU 101 determines whether there is a failure based on the information of the selected paper feeding apparatus. If the CPU 101 determines that there is a failure in the selected paper feeding apparatus in S602, the CPU 101 proceeds to step S603 to disable the use of the paper feeding apparatus (paper deck 305 here) and ends the process. If the CPU 101 determines that there is no failure in the paper feeding apparatus in step S602, the CPU 101 ends the process.

Figure 7A:
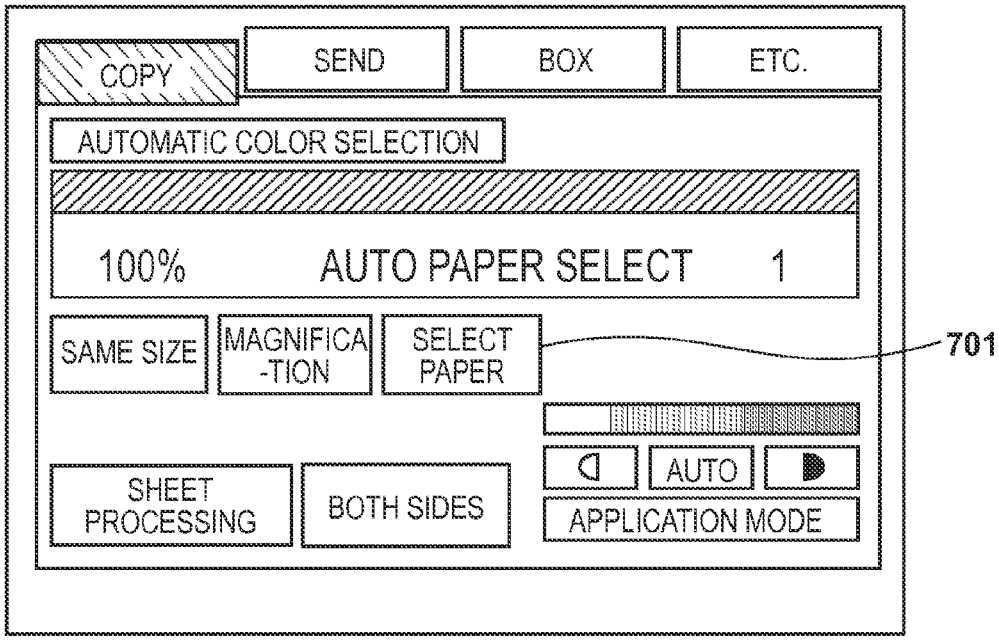
FIGS. 7A to 7C depict views, each showing an example of an operation screen in copying in the image forming apparatus according to the first embodiment.
Figure 7B:
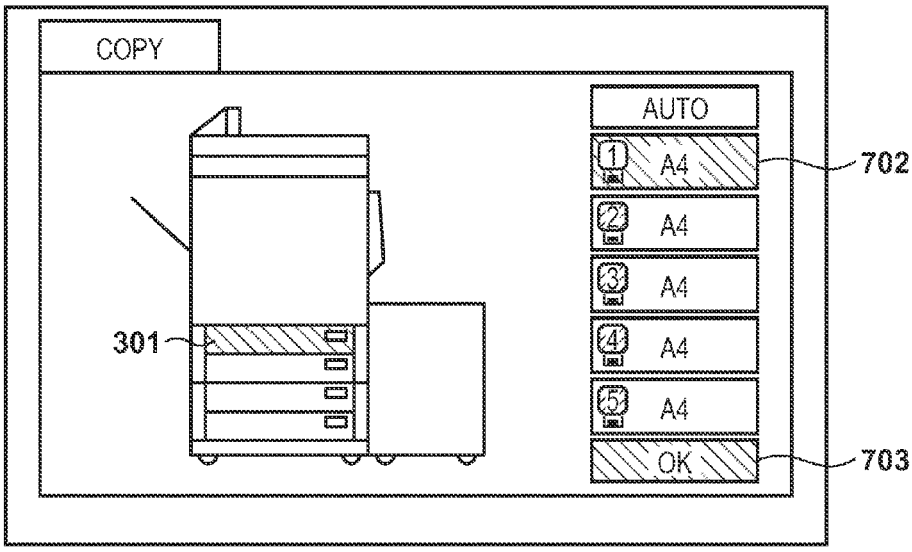
Figure 7C:
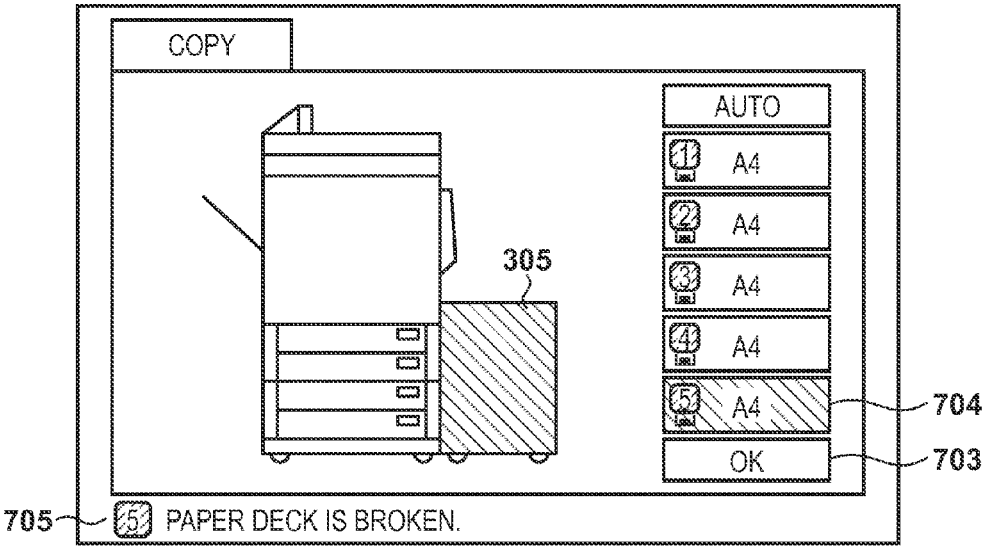

FIGS. 7A to 7C depict views, each showing an example of an operation screen in copying in the image forming apparatus according to the first embodiment. The display unit of the console unit 115 has a touch panel function here.

FIG. 7A illustrates an example of an initial operation screen of copying, and when the user touches a "Select Paper" button 701 here, the screen shifts to a selection screen of paper feeding apparatuses illustrated in FIG. 7B. In FIG. 7B, when the paper feeding cassette 301 housing A4 size paper indicated by a button (icon) 702 is selected, an OK button 703 for confirming the selection can be pressed.

Meanwhile, when a button (icon) 704 corresponding to the paper deck 305 with a failure is selected in FIG. 7C, the OK button 703 for confirming the selection is displayed so that the press is not accepted even if the button 703 is pressed. The reason that the OK button 703 is not accepted is described in a message 705. In FIG. 7C, the selection of the button 704 corresponding to the paper deck 305 with a failure may be prohibited.

In this way, when the user attempts to select a paper feeding cassette with a failure in the printing process, the printing process is controlled so that the selection is not accepted. This can prevent a situation that the printing process is not executed as a result of the user selecting a paper feeding unit with a failure.

Figure 8A:
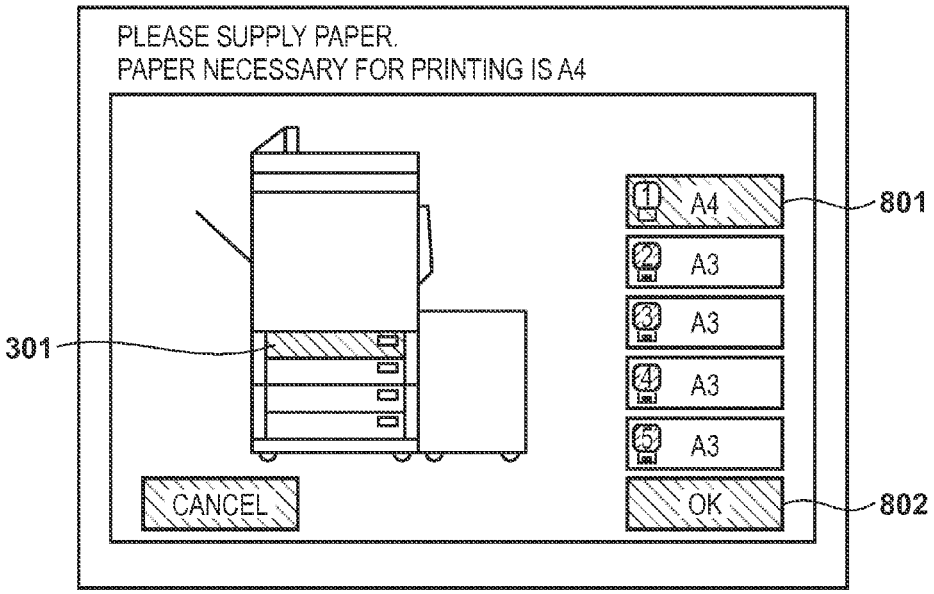
FIGS. 8A and 8B depicts views, each showing an example of an instruction screen of paper supply in the image forming apparatus according to the first embodiment.
Figure 8B:
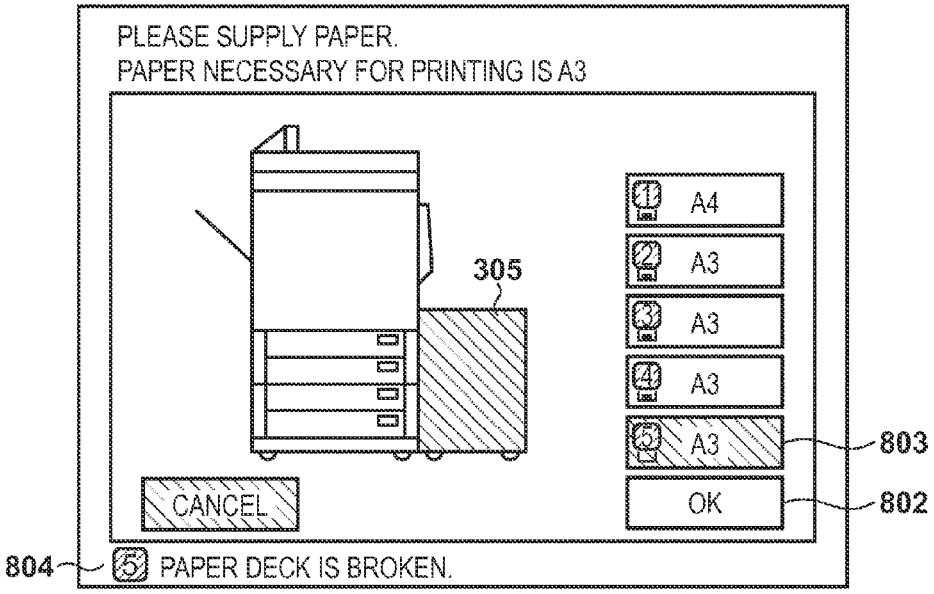

FIGS. 8A and 8B depict views, each showing an example of an instruction screen of paper supply in the image forming apparatus according to the first embodiment.

FIG. 8A shows a state that the paper feeding cassette 301 corresponding to a button 801 is selected, and there is no more paper in the paper feeding cassette 301. It can be recognized here that supply of paper to the selected paper feeding cassette is prompted, and the paper necessary for printing is A4 size paper. The paper feeding cassette 301 is not broken in this state, and the printing can be continued if the paper is supplied. Therefore, an OK button 802 can be pressed.

Meanwhile, the state of FIG. 8B indicates a state in which the paper deck 305 corresponding to a button 803 is selected, supply of paper is prompted, and there is no more paper in the paper deck 305. However, the paper deck 305 is broken in this state, and the printing cannot be continued even if the paper is supplied. Therefore, the OK button 802 is displayed so that the press is not accepted even if the OK button 802 is pressed. The reason that the OK button 802 is not accepted is described in a message 804. In this case, the selection of the button 803 corresponding to the paper deck 305 may also be prohibited in the screen of FIG. 8B.

As described, according to the first embodiment, a paper feeding apparatus with a failure is presented to a user when there is a failure in the paper feeding apparatus, and the paper feeding apparatus cannot be selected for printing process. A paper feeding apparatus other than the paper feeding apparatus with the failure can be used to continue the printing process.

A paper feeding unit with a failure cannot be selected for a print job (image forming job), and this can prevent a situation that the print job cannot be executed due to the failure of the paper feeding unit. Another paper feeding unit without a failure can be selected, and the print job can be executed even if there is a paper feeding unit with a failure.

Second Embodiment

In the first embodiment, an example of limiting the selection of the paper feeding apparatus on the screen displayed on the console unit 115 when a failure of the paper feeding apparatus is detected is described. In a second embodiment, operation of automatic paper selection when a failure of a paper feeding apparatus is detected will be described. The hardware configuration of the image forming apparatus according to the second embodiment is the same as that of the first embodiment, and the description will not be repeated.

Figure 9:
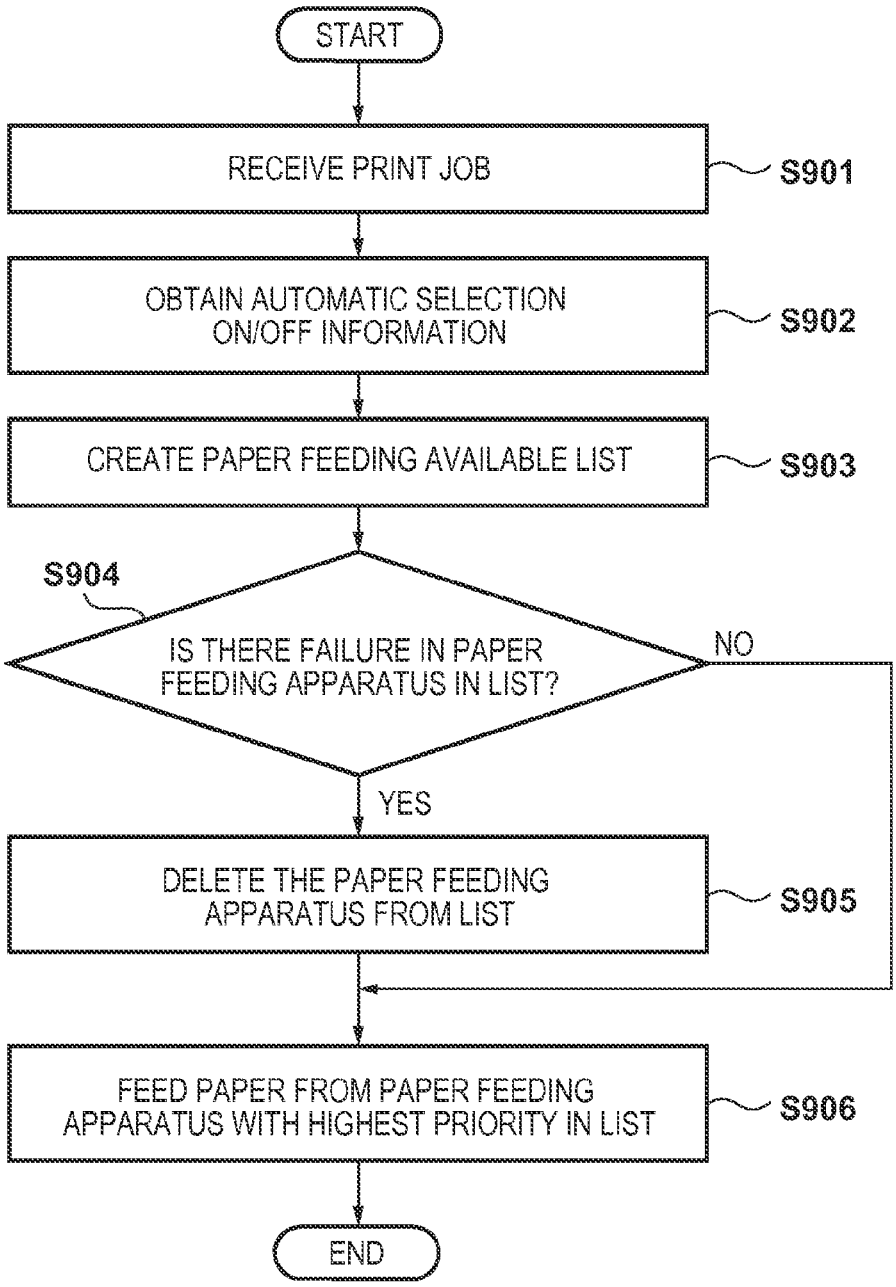
FIG. 9 is a flowchart for describing a selection process of a paper feeding apparatus to be selected at printing when a failure is detected in a paper feeding apparatus in an image forming apparatus according to a second embodiment of the present invention.

FIG. 9 is a flowchart for describing a selection process of a paper feeding apparatus used in printing when a failure is detected in a paper feeding apparatus in the image forming apparatus according to the second embodiment of the present invention. The CPU 101 executes a program deployed from the HDD 104 into the RAM 102 to attain the process illustrated in the flow chart.

In step S901, the CPU 101 receives a print job. The CPU 101 proceeds to step S902 and obtains information, such as paper information (size and print direction), included in the print job and ON/OFF information of automatic cassette selection held in the RAM 102. The print job in the second embodiment is a copy job, and the job may be a print job received through a network or a print job for printing document data held in a box. When the ON/OFF information of the automatic cassette selection held in the RAM 102 is set to ON, a paper feeding cassette or a deck housing the paper according to the paper size and the paper type designated in the print job is automatically selected.

The CPU 101 proceeds to step S903 and creates a list (paper feeding available list) of the paper feeding apparatuses that can feed paper in the execution of the print job based on the paper information included in the received print job and based on the ON/OFF information of the automatic cassette selection obtained in step S902. A case in which the automatic cassette selection information is ON will be described here. Priorities of the paper feeding apparatuses determined in advance are taken into account to determine the order of display of the paper feeding available list.

Figure 10A:
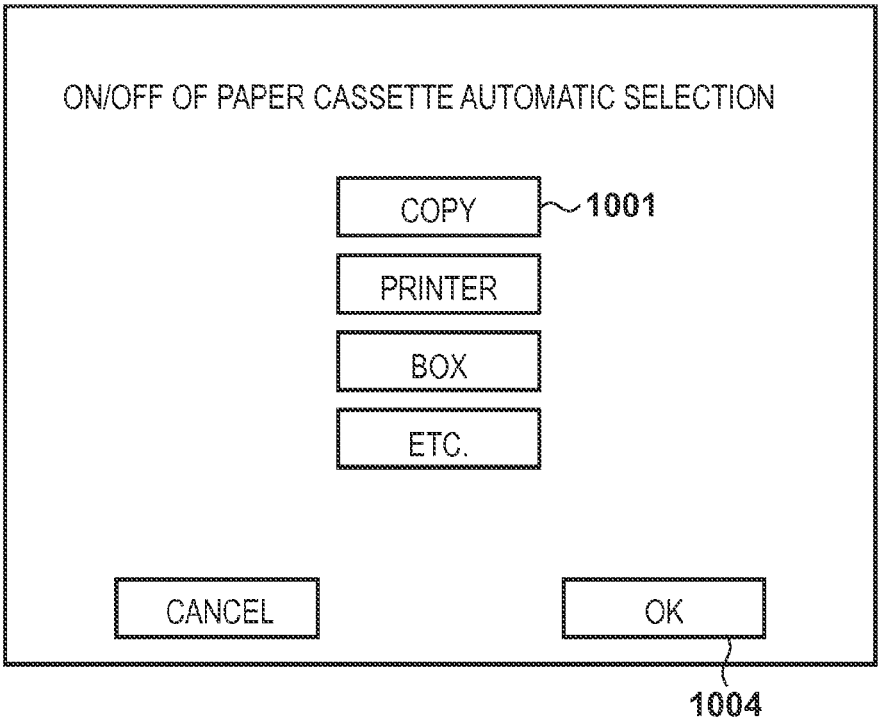
FIGS. 10A and 10B depict views, each showing an example of a screen displayed on a console unit of the image forming apparatus according to the second embodiment.
Figure 10B:
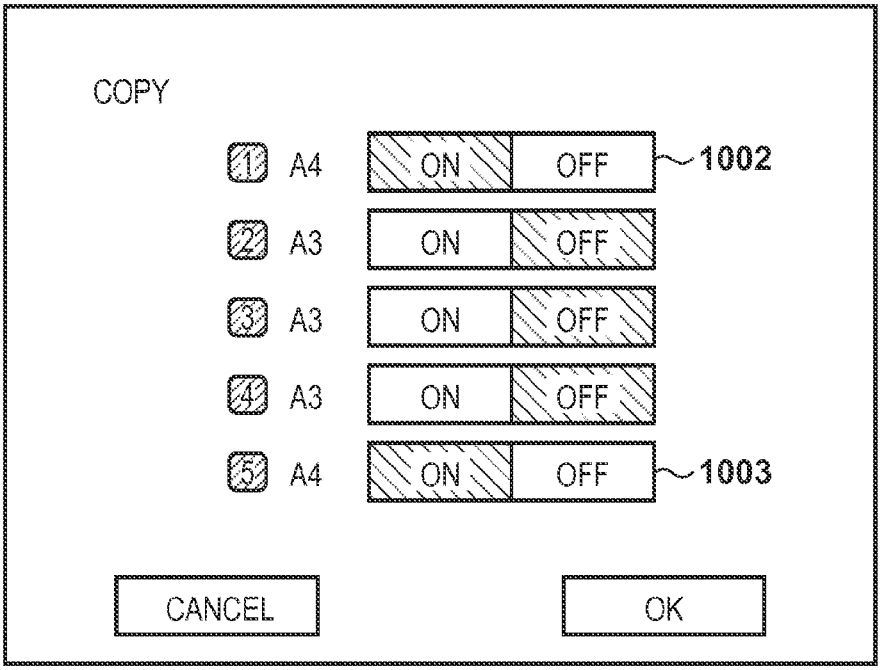

FIGS. 10A and 10B depict views, each showing an example of a screen displayed on the console unit 115 of the image forming apparatus according to the second embodiment.

In FIG. 10A, ON/OFF of the automatic cassette selection can be set for each job type, such as "Copy", "Printer" (print job based on data from PC), and "Box". When a "Copy" button 1001 is pressed, and an OK button 1004 is pressed, the automatic cassette selection is set to ON in a copy mode.

FIG. 10B depicts a view showing an example of a screen displayed when the OK button 1004 is pressed after the copy button 1001 is selected on the screen of FIG. 10A. A list of the paper feeding apparatuses that can be used in the copy job is displayed here.

In FIG. 10B, paper feeding cassettes or paper feeding decks corresponding to buttons 1002 and 1003 house A4 size paper, and the buttons 1002 and 1003 are set to "ON". As a result, it can be recognized that the paper feeding cassette 301 and the paper deck 305 can be used in the copy job. In FIG. 10B, the priority of the paper feeding cassette 301 is the highest (priority 1), and the priority of the paper deck 305 is the lowest (priority 5).

The CPU 101 proceeds to step S904 and determines whether there is a failure in the paper feeding cassettes or the paper decks included in the paper feeding available list displayed in step S903. If the CPU 101 determines that there is no paper feeding cassette or paper deck with a failure in step S904, the CPU 101 proceeds to step S906. If the CPU 101 determines that there is a paper feeding cassette or a paper deck with a failure in step S904, the CPU 101 proceeds to step S905. In step S905, the CPU 101 removes the display of the paper feeding apparatus with the failure from the paper feeding available list and displays the list. The CPU 101 proceeds to step S906 and transmits, to the printer 114, a paper feeding instruction for the paper feeding apparatus with the highest priority in which ON is set in the paper feeding available list.

For example, if there is a failure in the paper deck 305 corresponding to the button 1003 when the buttons 1002 and 1003 are both set to "ON" in FIG. 10B, the button 1003 corresponding to the deck 305 is deleted to display the paper feeding available list.

In the second embodiment, a screen for instructing supply of paper to the paper feeding cassette 301 is displayed when there is no paper because all of the paper in the paper feeding cassette 301 is used during the execution of the print job.

When there is no paper feeding apparatus displayed on the paper feeding available list, a screen for supplying paper to a usable paper feeding apparatus is displayed according to the predetermined priorities of the paper feeding apparatuses.

As described, according to the second embodiment, the user of the image forming apparatus is able to prevent the broken paper feeding apparatus from being designated for printing when a failure is detected in the paper feeding apparatus.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-084000, filed Apr. 15, 2014, which is hereby incorporated by reference herein in its entirety.

What is claimed is:

1. An image forming apparatus having a plurality of paper feeding units, the image forming apparatus comprising:

a first detection unit configured to detect out-of-paper in at least one of the plurality of paper feeding units;

a second detection unit configured to detect a failure in at least one of the plurality of paper feeding units;

a selection unit configured to select one of the plurality of paper feeding units that is to be used as a paper feeding source of paper; and a control unit configured to control the selection unit to permit selecting the paper feeding unit in which the out-of-paper is detected by the first detection unit and to control the selection unit not to permit selecting the paper feeding unit in which the failure is detected by the second detection unit.

2. The image forming apparatus according to claim 1, further comprising:

a display unit configured to display information indicating a failure when the second detection unit detects the failure.

3. The image forming apparatus according to claim 2, wherein the display unit displays the information in response to an instruction of a user for selecting the paper feeding unit in which the failure is detected by the second detection unit.

4. The image forming apparatus according to claim 1, wherein the second detection unit determines that there is a failure when paper cannot be lifted up to a paper feeding position in a paper feeding unit.

5. The image forming apparatus according to claim 1, wherein the second detection unit determines that there is a failure when there is an abnormality in a sensor included in a paper feeding unit.

6. A method of controlling an image forming apparatus comprising a plurality of paper feeding units, the method comprising:

a first detection step of detecting out-of-paper in at least one of the plurality of paper feeding units;

a second detection step of detecting a failure in at least one of the plurality of paper feeding units;

a selection step of selecting one of the plurality of paper feeding units that is to be used as a paper feeding source of paper; and a control step of controlling the selection step to permit selecting the paper feeding unit in which the out-of-paper is detected in the first detection step and of controlling the selection step not to permit selecting the paper feeding unit in which the failure is detected in the second detection step.

7. A non-transitory computer-readable storage medium storing a program for causing a computer to execute the method defined by claim 6.

* * * * *